US008660447B2

(12) United States Patent
Do et al.

(10) Patent No.: US 8,660,447 B2
(45) Date of Patent: Feb. 25, 2014

(54) MULTI-PASS IMAGE FORMING APPARATUS HAVING VOLTAGE DIVIDER

(75) Inventors: Ki-jae Do, Suwon-si (KR); Byoung-chul Bae, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 632 days.

(21) Appl. No.: 12/926,801

(22) Filed: Dec. 9, 2010

(65) Prior Publication Data

US 2011/0142477 A1 Jun. 16, 2011

(30) Foreign Application Priority Data

Dec. 15, 2009 (KR) ..... 10-2009-0125037

(51) Int. Cl.
*G03G 15/06* (2006.01)
*G03G 15/01* (2006.01)

(52) U.S. Cl.
USPC ..... 399/55; 399/88; 399/228

(58) Field of Classification Search
USPC ..... 399/55, 88, 228
See application file for complete search history.

(56) References Cited

U.S. PATENT DOCUMENTS

| | | | | | |
|---|---|---|---|---|---|
| 5,376,998 | A * | 12/1994 | Suzuki | ..... | 399/88 |
| 5,621,630 | A * | 4/1997 | Suzuki et al. | ..... | 399/88 |
| 5,627,722 | A * | 5/1997 | Hirst | ..... | 399/228 |
| 7,308,221 | B2 * | 12/2007 | An et al. | ..... | 399/228 |
| 2002/0067929 | A1 * | 6/2002 | James et al. | ..... | 399/88 |
| 2007/0019980 | A1 * | 1/2007 | Kim et al. | ..... | 399/228 |

FOREIGN PATENT DOCUMENTS

| | | | | | |
|---|---|---|---|---|---|
| JP | 08110672 | A * | 4/1996 | ..... | G03G 15/01 |
| JP | 08137171 | A * | 5/1996 | ..... | G03G 15/01 |
| JP | 8-248731 | | 9/1996 | | |
| JP | 08278679 | A * | 10/1996 | ..... | G03G 15/01 |
| JP | 9-90706 | | 4/1997 | | |
| KR | 10-0503468 | | 7/2005 | | |

* cited by examiner

*Primary Examiner* — David Gray
*Assistant Examiner* — Laura Roth
(74) *Attorney, Agent, or Firm* — Staas & Halsey LLP

(57) ABSTRACT

An image forming apparatus includes a plurality of developing devices to develop toners of different colors on an image carrier; a power supply to supply the plurality of developing devices with a first voltage to develop the toners on the image carrier; a switching unit to connect the power supply to one of the plurality of developing devices; and a voltage divider to supply some of the other developing devices that are not connected to the power supply with a second voltage to prevent toner development and to supply any other remaining developing device with a third voltage, an absolute value of which is less then an absolute value of the second voltage.

19 Claims, 3 Drawing Sheets

MULTI-PASS IMAGE FORMING APPARATUS HAVING VOLTAGE DIVIDER

CROSS-REFERENCE TO RELATED APPLICATIONS

This application claims the benefit of Korean Patent Application No. 10-2009-0125037, filed on Dec. 15, 2009, in the Korean Intellectual Property Office, the disclosure of which is incorporated herein in its entirety by reference.

BACKGROUND

1. Field

The present general inventive concept relates to an image forming apparatus, and more particularly, to a multi-pass type image forming apparatus.

2. Description of the Related Art

An image forming apparatus transfers an image signal in the form of a visible image on a printing medium, e.g., paper, according to a digital signal inputted from a computer or scanner. The image forming apparatus may be a laser beam printer, which forms an image via an electrostatic latent image. A color laser printer uses yellow Y, magenta M, cyan C, and black K toners and a desired color image is formed by sequentially developing toner images of different colors and superimposing them. In particular, to obtain a desired color, while a particular color toner is being used by a developing device, different color toners should not be used by other developing devices.

SUMMARY

One or more embodiments of the present general inventive concept provide an image forming apparatus but the present general inventive concept may be embodied in many different forms and should not be construed as being limited to the embodiments set forth herein.

According to an aspect, there is provided an image forming apparatus including: a plurality of developing devices for developing toners of different colors on an image carrier; a power supply for supplying the plurality of developing devices with a first voltage to develop the toners on the image carrier; a switching unit for connecting the power supply to one of the plurality of developing devices; and a voltage divider for supplying some of the other developing devices that are not connected to the power supply with a second voltage for preventing toner development and supplying any other remaining developing device with a third voltage, an absolute value of which is less than an absolute value of the second voltage.

According to another aspect, there is provided a multi-pass type image forming apparatus including a plurality of fixed developing devices performing development, the multi-pass type image forming apparatus further including: a power supply for supplying one of the plurality of developing devices with a first voltage to develop toners on an image carrier; and a voltage divider for supplying some of the developing devices which are not connected to the power supply with a second voltage for preventing toner development and supplying any other remaining developing device which is not connected to the power supply with a third voltage, an absolute value of which is smaller than an absolute value of the second voltage.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

The present general inventive concept will now be described more fully with reference to the accompanying drawings, in which exemplary embodiments of the present general inventive concept are shown.

Figure 1:
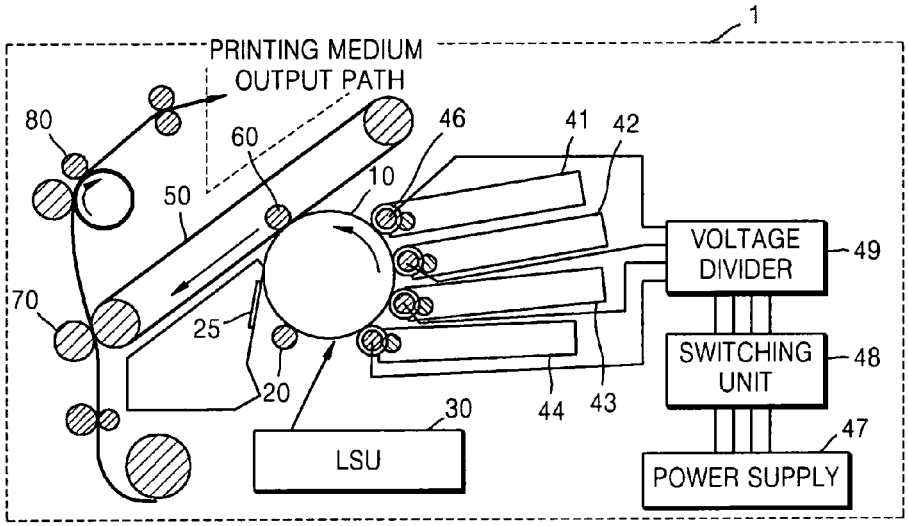
FIG. 1 is a schematic view of an image forming apparatus according to an embodiment.

FIG. 1 is a schematic view of an image forming apparatus 1 according to an embodiment. Referring to FIG. 1, the image forming apparatus 1 includes an image carrier 10 such as an organized photo conductor (OPC) drum or optical photo conductor drum, a charge roller (CR) 20, a cleaning unit 25, a laser scanning unit (LSU) 30, a plurality of developing devices 41, 42, 43, and 44, a power supply 47, a switching unit 48, a voltage divider 49, an intermediate transfer belt (ITB) 50, a first transfer roller (TR) 60, a second transfer roller 70, and a fusing roller (FR) 80. The developing devices 41, 42, 43, and 44 are a Y developing device 41, an M developing device 42, a C developing device 43, and a K developing device 44. Although not shown in FIG. 1, the image forming apparatus 1 may further include other elements, such as a switch mode power supply (SMPS), an engine controller, a processor, and a memory device.

A printing process of the image forming apparatus 1 will now be described.

The image forming apparatus 1, which may be a laser beam printer, forms an electrostatic latent image by irradiating a laser beam onto the image carrier 10 from the LSU 30 according to an image signal. Thereafter, the electrostatic latent image is transferred to a printing medium by sequentially developing the electrostatic latent image with toners from the respective developing devices 41, 42, 43, and 44 and transferring the developed toner images to the ITB 50 through the first TR 60 and the second TR 70. Thereafter, the fusing roller 80 fuses the toner images transferred onto the printing medium to form a final image. The cleaning unit 25 removes remaining toner after printing is completed.

In more detail, when printing starts, the charge roller 20 charges a surface of the image carrier 10 with a negative (−) polarity. The LSU 30 irradiates a laser beam onto the surface of the image carrier 10 charged with the negative (−) polarity to form an electrostatic latent image. At this time, the electrostatic latent image irradiated by the laser beam has a positive (+) polarity and the remaining portion of the image carrier 10 has the negative (−) polarity. Thereafter, the electrostatic latent image is sequentially developed with toners from the respective developing devices 41, 42, 43, and 44 having the negative (−) polarity, so that toners having the negative (−)

polarity are adhered to the electrostatic latent image having the positive (+) polarity on the image carrier 10.

The electrostatic latent image on which toners are adhered is first transferred to the ITB 50 by the first transfer roller 60 and is secondly transferred to the printing medium while the printing medium passes between the ITB 50 and the second transfer roller 70. The second transfer roller 70 has the positive (+) polarity so as to transfer toners having the negative (−) polarity while the printing medium is being transferred. Although it has been described that the toners of the developing devices 41, 42, 43, and 44 have the negative (−) polarity, the present general inventive concept is not limited thereto and toners having positive (+) polarity may be used.

A color laser printer may print multi-color images using a single pass-type method or a multi-pass type method. In the single-pass type method, all colors are printed at the same time by using several image carriers and developing devices corresponding to the image carriers. In the multi-pass type method, one image carrier and several developing devices are used, and toner development is repeated several times for each color in order to overlap the colors. Therefore, the image forming apparatus 1 having the developing devices 41, 42, 43, and 44 uses the multi-pass type method, and the image carrier 10 and the ITB 50 are respectively rotated four times to print a color image corresponding to one page.

Developing devices are generally classified into moving developing devices that move toward an image carrier to perform toner development, and fixed developing devices that are separated from an image carrier by a predetermined gap to sequentially perform toner development. The developing devices 41, 42, 43, and 44 in the image forming apparatus 1 of the present embodiment are fixed developing devices. A gap ring 46 is placed over each of the developing devices 41, 42, 43, and 44 to fix them and form a predetermined gap with respect to the image carrier 10. However, it will be understood by one of ordinary skill in the art that the present embodiment may be applied to moving developing devices, too.

As illustrated in FIG. 1, the developing devices 41, 42, 43, and 44 are arranged in the order of the Y developing device 41, the M developing device 42, the C developing device 43 and the K developing device 44 from top to bottom. When a page is printed, toner developing is sequentially performed by the Y developing device 41, the M developing device 42, the C developing device 43 and the K developing device. In the current embodiment, the developing devices 41, 42, 43, and 44 are sequentially connected to the power supply 47. It will be understood by one of ordinary skill in the art that the arrangement of the developing devices 41, 42, 43, and 44 and the connection of the developing devices 41, 42, 43, and 44 to the power supply 47 may be arbitrarily changed.

The power supply 47 sequentially applies a high voltage to the developing devices 41, 42, 43, and 44 one by one, so that the toners of the developing devices 41, 42, 43, and 44 are sequentially developed on the image carrier 10. In general, the high voltage supplied to the developing devices 41, 42, 43, and 44 has a negative (−) polarity, and thus, the toners in the developing device 41, 42, 43, 44 have the negative (−) polarity.

Although not shown in FIG. 1, the power supply 47 may supply a high voltage to other devices as well as the developing devices 41, 42, 43, and 44. The high voltage supplied from the power supply 47 includes AC and DC components.

The moving directions of toners are determined according to the polarity of the high voltage supplied from the power supply 47. In more detail, when the high voltage is supplied, the moving directions of toners are determined according to a developing vector. The developing vector is a vector obtained by subtracting a potential of the surface of the image carrier 10 from a DC component of a developing bias voltage. That is, in the case of using a toner having negative (−) polarity, when the developing vector is negative, the toners of the developing devices 41, 42, 43, and 44 move to a portion of the image carrier 10 having positive (+) polarity, and when the developing vector is positive, the toners of the developing devices 41, 42, 43, and 44 do not move.

If the toner polarity changes to positive, the toner moves in an opposite direction to the previous direction. Hereinafter, although a case where the polarity of toner is negative will be described exemplarily, a case where the polarity of toner is positive will be also easily understood by one of ordinary skill in the art.

When the switching unit 48 is switched on, only one of the developing devices 41, 42, 43, and 44 is connected to the power supply 47.

In more detail, the respective developing devices 41, 42, 43, and 44 are sequentially connected to the power supply 47 by an operation of solenoid switches included in the switching unit 48. Since the image forming apparatus 1 of the present embodiment employs a multi-pass type method, the respective solenoid switches are switched on or off according to a control signal of a switching controller (not shown). Thus, the developing devices 41, 42, 43, and 44 are sequentially connected to the power supply 47.

According to the present embodiment, when the switching unit 48 is in operation, the Y developing device 41 is first connected to the power supply 47, and then, the M developing device 42, the C developing device 43 and the K developing device 44 are sequentially connected to the power supply 47. That is, in the image forming apparatus 1 of the present embodiment, toner development is performed in the order from the Y developing device 41 fixed at the uppermost place to the K developing device 44 fixed at the lowermost place but the toner development order may be changed.

The voltage divider 49 applies a DC voltage to some of three developing devices that are not connected to the power supply 47 from among the developing devices 41, 42, 43, and 44, in order to prevent toner development thereof, and applies a voltage less than the absolute value of the DC voltage to any other remaining developing device not connected to the power supply 47 in order to prevent toner development thereof. Herein, the voltage less than the absolute value of the DC voltage may be a ground voltage, or may be a voltage that is smaller than the absolute value of the DC voltage and that has the same polarity as the DC voltage. The any other remaining developing device may be the K developing device 44. The high voltage and the DC voltage have the same polarity.

In more detail, a relationship of voltages applied to the respective developing devices 41, 42, 43, and 44 may be expressed as in the following equation below:

$$V_{ac+dc} > V_{dcy}, V_{dcm}, V_{dcc} > V_{dck} \geq V_{ground}, \quad (1)$$

where $V_{ac+dc}$ indicates a high voltage applied to any one of the developing devices 41, 42, 43, and 44 that is operating, and $V_{dcy}$, $V_{dcm}$ and $V_{dcc}$ indicate DC voltages applied when the Y developing device 41, the M developing device 42 and the C developing device 43 are not used operating, respectively. $V_{dck}$ indicates a DC voltage applied when the K developing device 44 is not operating. Referring to Equation (1), the voltage $V_{dck}$ applied when the K developing device 44 is not operating is smaller than the voltage $V_{dcy}$, $V_{dcm}$ and $V_{dcc}$ applied when the remaining developing devices 41, 42, and 43 are not operating. The voltage $V_{dck}$ is equal to or greater than the ground voltage $V_{ground}$.

The reason why the foregoing voltages are applied is as follows.

When printing one page, only one selected solenoid switch of the switching unit 48 operates, and thus, a high voltage is supplied only to the developing device corresponding to the selected solenoid switch. Accordingly, toners of the remaining developing devices are not developed.

There are two types of cross contamination. In the first type, toners from the developing devices not supplied with a high voltage are transferred to an electrostatic latent image on the image carrier 10. In the second type, toners on the developed image carrier 10 are transferred to the developing device that starts operating.

In more detail, as described above, a high voltage including AC and DC components is supplied from the power supply 47 to a metal shaft of a developing device in which the solenoid switch is connected, so that the toner in the developing device has a strong negative (−) polarity. The toner having a strong negative (−) polarity is adhered to an electrostatic latent image having a positive (+) polarity on the image carrier 10 and the electrostatic latent image is developed with the toner. However, in a conventional color image forming apparatus, to prevent cross contamination by toners of all remaining developing devices in which the solenoid switches are not connected, a DC voltage having a negative (−) polarity is supplied to these developing devices to stabilize the electric potentials of metal shafts of the remaining developing devices. If the electric potentials of these metal shafts are not stabilized, the electric potentials become a floating state and unstable, so that the toners of these developing devices cause cross contamination. Accordingly, if a DC voltage having the negative (−) polarity is supplied to the remaining developing devices that the solenoid switches are not connected, the metal shafts of the remaining developing devices are not in a floating state but are stabilized while having a DC voltage having the negative (−) polarity. That is, since the amount of a developing vector, which is obtained by subtracting an electric potential of the surface of the image carrier 10 having the toner developed by the developing device participating in a previous developing operation from a DC component of a developing bias voltage, is decreased, cross contamination can be prevented.

However, since the electrostatic latent image of the image carrier 10 has the positive (+) polarity and the toners of the remaining developing devices, which have the negative (−) polarity and are stabilized, have a weak negative (−) polarity, some cross contamination occurs. In particular, in the case of cross contamination in which black (K) toner contaminates yellow (Y) toner, a color image desired by a user cannot be printed.

Therefore, unlike the Y, M, and C developing devices 41, 42, and 43, when the K developing device 44 is not supplied the high voltage from the power supply 47, the metal shaft of the K developing device 44 is stabilized by applying thereto not a DC voltage having negative (−) polarity but a ground voltage. This is because if the K developing device 44 is stabilized by a ground voltage, black (K) toner of the K developing device 44 has almost no polarity or has a polarity weaker than the remaining Y, M, and C developing devices 41, 42, 43, so that contamination of the black (K) toner is less than contamination of the electrostatic latent image having the positive (+) polarity on the image carrier 10 or than contamination of the remaining developing devices. That is, occurrence of cross contamination of the black (K) toner of the K developing device 44 decreases.

In the case where the polarity of toner is positive, the DC voltage divided from the voltage divider 49 has the positive (+) polarity, and in the case where the polarity of toner is negative, the DC voltage divided from the voltage divider 49 has the negative (−) polarity.

As described above, among the developing devices 41, 42, 43, and 44 according to the present embodiment, in the case where the K developing device 44 is not connected to the power supply 47 unlike the remaining developing devices 41, 42, and 43, a ground voltage is supplied to K developing device 44. This will be described in more detail with reference to FIG. 2.

Figure 2:
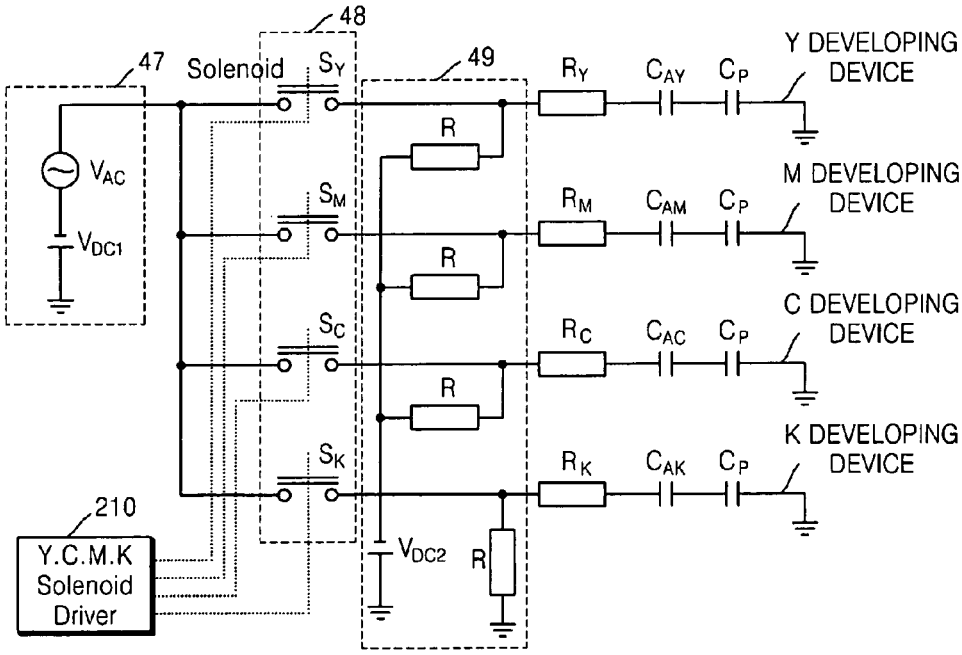
FIG. 2 is a circuit diagram of an image forming apparatus according to an embodiment.

FIG. 2 is a circuit diagram of the image forming apparatus of FIG. 1, according to an embodiment of the present general inventive concept. Referring to FIG. 2, the power supply 47, the switching unit 48, the voltage divider 49 and a solenoid driver 210 included in the image forming apparatus 1 of FIG. 1 are shown in a circuit diagram. In FIG. 2, $C_{AY}$, $C_{AM}$, $C_{AC}$ and $C_{AK}$ respectively represent capacitances due to gaps between the Y developing device 41 and the image carrier 10, between the M developing device 42 and the image carrier 10, between the C developing device 43 and the image carrier 10 and between the K developing device 44 and the image carrier 10. $C_P$ represents a capacitance of the image carrier 10 which is a dielectric substance. $R_Y$, $R_M$, $R_C$ and $R_K$ represent resistances of metal shafts of the Y developing device 41, the M developing device 42, the C developing device 43, and the K developing device 44, respectively.

As described with reference to FIG. 1, the power supply 47 sequentially supplies a high voltage including an AC component $V_{AC}$ and a DC component $V_{DC1}$ to any of the developing devices 41, 42, 43, 44. The switching unit 48 includes solenoid switches $S_Y$, $S_M$, $S_C$ and $S_K$ corresponding to the developing devices 41, 42, 43 and 44, respectively. The solenoid driver 210 transmits a control signal and controls mechanical contact points of the solenoid switches $S_Y$, $S_M$, $S_C$, and $S_K$. Therefore, if the solenoid driver 210 drives only one of the solenoid switches, the power supply 47 is connected only to one developing device. The developing device connected to the power supply 47 develops toner on the image carrier 10.

A DC voltage $V_{DC2}$ of the voltage divider 49 is connected to the Y, M, and C developing devices 41, 42 and 43 through a resistance R, and the K developing device 44 is grounded through a resistance R. The reason why the K developing device 44 is grounded has been described above with reference to FIG. 1 and Equation 1.

Since cross contamination in which black (K) toner contaminates yellow (Y) toner has a fatal influence on an image, a color image desired by a user cannot be printed. To prevent cross contamination in a conventional image forming apparatus, a DC voltage of −200 V is applied to all of the remaining developing devices which are not connected to the power supply 47 to stabilize them, and thus minimize toner contamination. However, in the case of the conventional image forming apparatus, some toners including black toner may be transferred to the image carrier, thereby contaminating the electrostatic latent image of the image carrier.

However, in the image forming apparatus 1 according to the present embodiment, the electric potential of the K developing device 44 is maintained at a low level by connecting the K developing device 44 to ground, unlike the remaining developing devices.

For example, in the case where the Y developing device 41 is connected to the power supply 47, the DC voltage $V_{DC2}$ is supplied to the M and C developing devices 42 and 43, but a ground voltage is supplied to the K developing device 44 to stabilize the metal shaft of the K developing device 44. Accordingly, a developing electric field of the K developing device 44 is maintained lower than those of the Y, M and C developing devices 41, 42, and 43, the black toner of the K developing device 44 which is not connected to the power supply 47 does not move. When the K developing device 44 does not participate in developing, contamination due to the black toner can be decreased, compared with contamination due to toners of other colors. That is, cross contamination due to the black toner having a fatal influence on image quality can be minimized.

Figure 3:
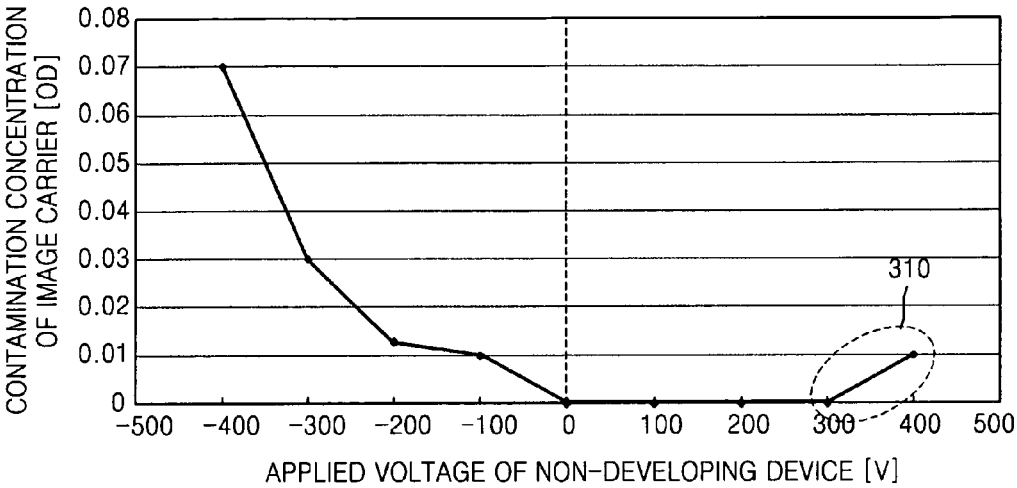
FIG. 3 (PRIOR ART)
FIG. 3 is a graph showing cross contamination occurring in a conventional image forming apparatus.

FIG. 3 is a graph showing cross contamination occurring in a conventional image forming apparatus. Referring to FIG. 3, in a conventional image forming apparatus, cross contamination 310 in which toners of non-developing devices which do not participate in developing are transferred to an image carrier occurs. Cross contamination 310 occurs because although a constant DC voltage is supplied to the non-developing devices to stabilize them, DC voltages of different levels may be applied to the non-developing devices as shown in FIG. 3. In particular, if the cross contamination 310 has a great influence on the black toner, an image quality may be deteriorated. However, in the image forming apparatus 1 of the present embodiment, when the K developing device 44 does not participate in developing and is connected to ground, contamination due to the black toner can be decreased.

Figure 4:
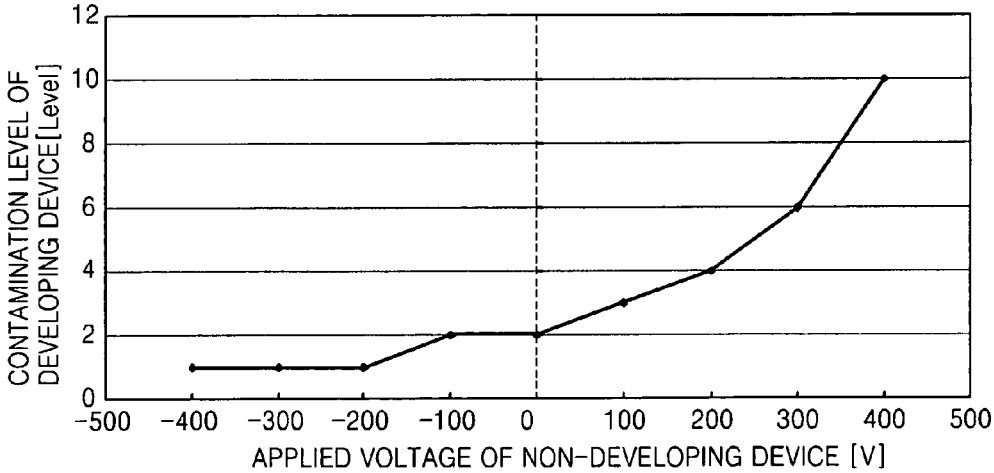
FIG. 4 (PRIOR ART)
FIG. 4 is a graph showing cross contamination occurring in a conventional image forming apparatus.

FIG. 4 is a graph showing cross contamination occurring in a conventional image forming apparatus. Referring to FIG. 4, it is seen that cross contamination in which toner is transferred from a non-developing device to another developing device occurs. That is, it is seen that when a voltage applied to a non-developing device increases, a concentration level of toner of a different color found in any developing device increases too. However, when the K developing device 44 does not participate in developing and is connected to ground like in the image forming apparatus 1 of the present embodiment, contamination due to the black toner can be decreased.

Figure 5A:
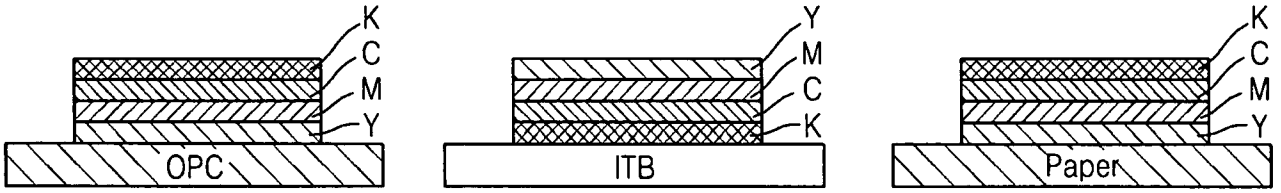
FIG. 5A is a cross-sectional view of an image including toners of different colors overlapped on each other according to an embodiment.

FIG. 5A is a cross-sectional view of an image including toners of respective colors overlapped on each other according to an embodiment of the present general inventive concept. Referring to FIG. 5A, when the image forming apparatus 1 operates, toners of the developing devices 41, 42, 43 and 44 are developed on the image carrier 10, the ITB 50, and on a printing medium such as a paper. Since the image forming apparatus 1 performs development in the order of Y, M, C, and K developing devices 41, 42, 43 and 44, toners are developed in the order of Y, M, C, and K on the image carrier 10. The toners on the image carrier 10 are transferred in the order of K, C, M and Y onto the ITB 50 and then transferred again in the order of Y, M, C, and K on the printing medium.

Figure 5B:
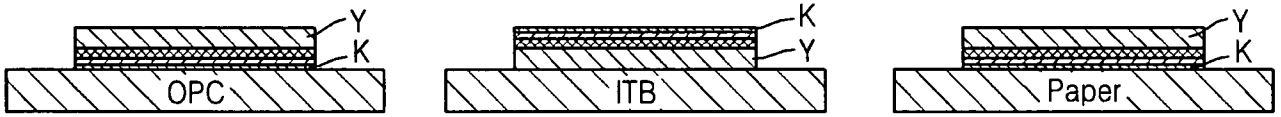
FIG. 5B (PRIOR ART)
FIG. 5B is a cross-sectional view of an image in which cross contamination occurs in a conventional image forming apparatus.

FIG. 5B is a cross-sectional view of an image in which cross contamination occurs in a conventional image forming apparatus. Referring to FIG. 5B, if only a Y developing device 41 performs development on a image carrier 10, yellow Y toner is mainly developed but toners of different colors are partially developed. Among the toners of different colors, magenta M and cyan C toners have a relatively small influence on the quality of an image developed with yellow Y toner, but since black K and yellow Y are near complementary colors, black K toner has a great influence on the quality of an image developed with yellow Y toner. That is, as shown in FIG. 5B, in the case of a conventional image forming apparatus, since a contamination degree of black K toner with respect to yellow Y toner is similar to those of other magenta M and cyan C toners, the quality of an image developed with yellow Y toner is lowered.

Figure 5C:
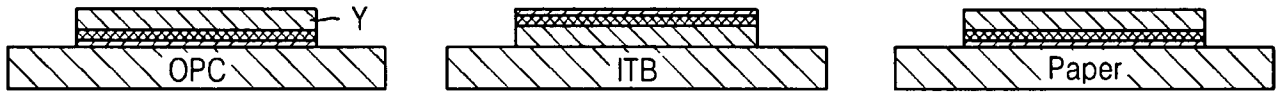
FIG. 5C is a cross-sectional view of an image developed using only yellow Y toner by an image forming apparatus according to an embodiment.

FIG. 5C is a cross-sectional view of an image developed using only yellow Y toner by the image forming apparatus 1, according to an embodiment of the present general inventive concept. Referring to FIG. 5C, unlike the case of FIG. 5B, if only the Y developing device 41 of the image forming apparatus participates in developing, contamination due to black K toner does not occur almost at all. That is, as described previously, when the K developing device 44 does not participate in developing, a ground voltage is supplied to stabilize the K developing device 44 of, so that black K toner does not move, and thus, cross contamination due to the black K toner hardly occurs at all.

According to the embodiments, in an image forming apparatus employing a multi-pass type method where development is performed by using a plurality of fixed developing devices, when toner of a single color is developed, an image can be prevented from being contaminated due to movement of toners of different colors, so that it is possible to print a high quality image specified by a user.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An image forming apparatus comprising:

a plurality of developing devices to develop toners of different colors on an image carrier;

a power supply to supply the plurality of developing devices with a first voltage to develop the toners on the image carrier;

a switching unit to connect the power supply to one of the plurality of developing devices; and a voltage divider to supply some of the other developing devices that are not connected to the power supply with a second voltage to prevent toner development and to supply any other remaining developing device with a third voltage, an absolute value of which is less than an absolute value of the second voltage.

2. The image forming apparatus of claim 1, wherein an absolute value of the first voltage is greater than the absolute value of the second voltage, the absolute value of the second voltage is greater than the absolute value of the third voltage, and the absolute value of the third voltage is greater than or equal to a ground voltage.

3. The image forming apparatus of claim 1, wherein the any other remaining developing device comprises a developing device having black toner.

4. The image forming apparatus of claim 1, wherein the plurality of developing devices are sequentially connected to the power supply by the switching unit, and the any other remaining developing device is lastly connected to the power supply when the plurality of developing devices are connected sequentially.

5. The image forming apparatus of claim 1, wherein the first and second voltages have the same polarity.

6. The image forming apparatus of claim 1, wherein the second voltage is a DC voltage having the same polarity as the toner.

7. The image forming apparatus of claim 1, wherein the plurality of developing devices are fixed and a constant gap is maintained between the plurality of developing device and the image carrier.

8. A multi-pass type image forming apparatus including a plurality of fixed developing devices performing development, the multi-pass type image forming apparatus comprising:

a power supply to supply one of the plurality of developing devices with a first voltage to develop toners on an image carrier; and a voltage divider to supply some of the developing devices which are not connected to the power supply with a second voltage for preventing toner development and to supply any other remaining developing device which is not connected to the power supply with a third voltage, an absolute value of which is smaller than an absolute value of the second voltage.

9. The multi-pass type image forming apparatus of claim 8, wherein an absolute value of the first voltage is greater than the absolute value of the second voltage, the absolute value of the second voltage is greater than the absolute value of the third voltage, and the absolute value of the third voltage is greater than or equal to a ground voltage.

10. The multi-pass type image forming apparatus of claim 8, wherein the plurality of developing devices are sequentially connected to the power supply by the switching unit, the any other remaining developing device is lastly connected to the power supply when the plurality of developing devices are connected sequentially, and the developing device lastly connected to the power supply is a developing device having black toner.

11. An image forming apparatus comprising:

developing devices including a yellow (Y) developing device, a magenta (M) developing device, a cyan (C) developing device and a black (K) developing device to develop toners of different colors on an image carrier;

a power supply to supply the developing devices with a first voltage to develop the toners on the image carrier;

a switching unit to connect the power supply to one of the developing devices; and a voltage divider to supply some of the other developing devices that are not connected to the power supply with a second voltage to prevent toner development and to supply any other remaining developing device with a third voltage.

12. The image forming apparatus of claim 11, wherein an absolute value of the first voltage is greater than an absolute value of the second voltage, the absolute value of the second voltage is greater than the absolute value of the third voltage, and the absolute value of the third voltage is greater than or equal to a ground voltage.

13. The image forming apparatus of claim 11, wherein the any other remaining developing device is the K developing device.

14. The image forming apparatus of claim 11, wherein the developing devices are sequentially connected to the power supply by the switching unit, and the any other remaining developing device is lastly connected to the power supply when the plurality of developing devices are connected sequentially.

15. The image forming apparatus of claim 11, wherein the first and second voltages have the same polarity.

16. The image forming apparatus of claim 11, wherein the second voltage is a DC voltage having the same polarity as the toner.

17. The image forming apparatus of claim 11, wherein the developing devices are fixed and a constant gap is maintained between the plurality of developing device and the image carrier.

18. The image forming apparatus of claim 11, wherein the developing devices are fixed so that the Y developing device is the uppermost developing device, the M developing device is below the Y developing device, the C developing device is below the M developing device, and the K developing device is the lowermost developing device.

19. The image forming apparatus of claim 18, wherein toner development occurs by connecting the power supply to the uppermost Y developing device sequentially to the M developing device, C developing device and lowermost K developing device.

* * * * *

UNITED STATES PATENT AND TRADEMARK OFFICE

CERTIFICATE OF CORRECTION

PATENT NO. : 8,660,447 B2
APPLICATION NO. : 12/926801
DATED : February 25, 2014
INVENTOR(S) : Do et al.

It is certified that error appears in the above-identified patent and that said Letters Patent is hereby corrected as shown below:

On the Title Page Item [57] (Abstract), Line 11, delete "then" and insert -- than --, therefor.

Signed and Sealed this
First Day of July, 2014

Michelle K. Lee

Michelle K. Lee
*Deputy Director of the United States Patent and Trademark Office*